US005749112A

United States Patent [19]

Metzler

[11] Patent Number: 5,749,112

[45] Date of Patent: May 12, 1998

[54] INVALID BED GUARD SHEET

[76] Inventor: Donald L. Metzler, 1003 Frontage Rd., Collinsville, Ill. 62234

[21] Appl. No.: 720,415

[22] Filed: Sep. 30, 1996

[51] Int. Cl.[6] ..... A47G 9/02; A47C 21/08

[52] U.S. Cl. ..... 5/663; 5/424; 5/425

[58] Field of Search ..... 5/424, 425, 427, 5/512, 663

[56] References Cited

U.S. PATENT DOCUMENTS

| | | | |
|---|---|---|---|
| 3,438,069 | 4/1969 | Long | 5/512 X |
| 3,742,530 | 7/1973 | Clark | 5/425 X |
| 4,232,415 | 11/1980 | Webber | 5/427 |
| 4,370,765 | 2/1983 | Webber | 5/427 |
| 4,910,818 | 3/1990 | Grabill et al. | 5/443 |
| 5,010,611 | 4/1991 | Mallett | 5/424 X |
| 5,044,025 | 9/1991 | Hunsinger et al. | 5/424 |
| 5,191,663 | 3/1993 | Holder et al. | 5/424 |
| 5,367,729 | 11/1994 | Lazar et al. | 5/494 |
| 5,481,772 | 1/1996 | Glynn et al. | 5/663 |

*Primary Examiner*—Michael F. Trettel
*Attorney, Agent, or Firm*—Don W. Weber

[57] ABSTRACT

An invalid bed guard sheet is presented for use with invalid beds having raisable guardrails. The guard sheet has a standard flat horizontal sheet which is placed over the mattress. Continuously attached to the sheet are left and right guard pads which may be folded over the guardrails. The inner and outer pads are then fastened to each other by means of buttons, VELCRO (TM) strips, or other fasteners. The guard sheet eliminates the gap between the mattress and the metal guard rails, thus making the bed safer for patients. The cushioning effect of the guard pads also makes the patient bed safer and more comfortable.

5 Claims, 2 Drawing Sheets

INVALID BED GUARD SHEET

BACKGROUND OF THE INVENTION

This invention relates to the field of invalid beds. More particularly, it presents an innovative sheet and pad for invalid bedrails which protects against the invalid's limbs from becoming trapped between the mattress and bedrails.

In the hospital bed field, invalid beds using raisable guardrails are common. These beds are the same as a conventional bed, however, they have left and right guardrails which may be raised approximately three feet above the level of the mattress. The purpose of these raised rails is to prevent the invalid from rolling off or falling from the bed thereby causing serious injury. One drawback of these bedrails is that they have, themselves, caused certain problems which may lead to injury.

In the standard invalid bed with guardrails, a gap is created between the side of the mattress and the guardrails when the rails are raised. A patient's legs or arms may easily become lodged between the mattress and the bedrail, sometimes resulting in serious injury.

Another problem with, the bedrails is that they are usually made of metal and may cause injury to the patient when a head, hand, leg, or other part of the body comes into contact with the metal bedrail. It has been known to use sheepskin or other thick padding on the raised bedrail to prevent injury when the patient comes into contact with the otherwise bare metal rail. However, the problem noted above, wherein the limb becomes lodged between the padding and the mattress, is still present.

It is an object of this invention to provide an invalid bed guard sheet such that the gap between the raised bedrail and the mattress is eliminated. It is another object of this invention to provide an invalid bed guard sheet such that the sheet is easily adaptable to all known invalid beds using guardrails. It is a still further object of this invention to provide a device which eliminates the gap between the mattress and a raised guardrail on an invalid bed when the rails are in the "up" position but which may be conveniently and neatly hung by the side of the bed when the rails are in the "down" position.

It is a still further object of this invention to provide an invalid bed guard sheet that is universally adaptable to invalid beds, and which promotes the safety and comfort of the patient when the sheet is in place. Other and further objects of this invention will become apparent upon reading the below described Specification.

BRIEF DESCRIPTION OF THE DEVICE

An invalid bed guard sheet device is presented which includes a flat sheet upon which the patient may rest along with left and right pad sections to be placed over the bedrails when they are raised. Since the left and right pad sections are continuous with the bottom horizontal sheet, the gap which normally occurs between the mattress and the guardrail is eliminated, thus eliminating the possibility that a patient's limbs may become lodged between the mattress and the guardrail or pads. The left and right guard pads may be made of sheepskin or other cushioned material to further enhance the comfort and safety of the device. The left and right guard pads are removably attachable to the guardrails by means of snaps, hook and loop fasteners or other fastening devices such that the invalid bed guard sheet is universally adaptable to an invalid bed.

DETAILED DESCRIPTION OF THE PREFERRED EMBODIMENT

Figure 1:
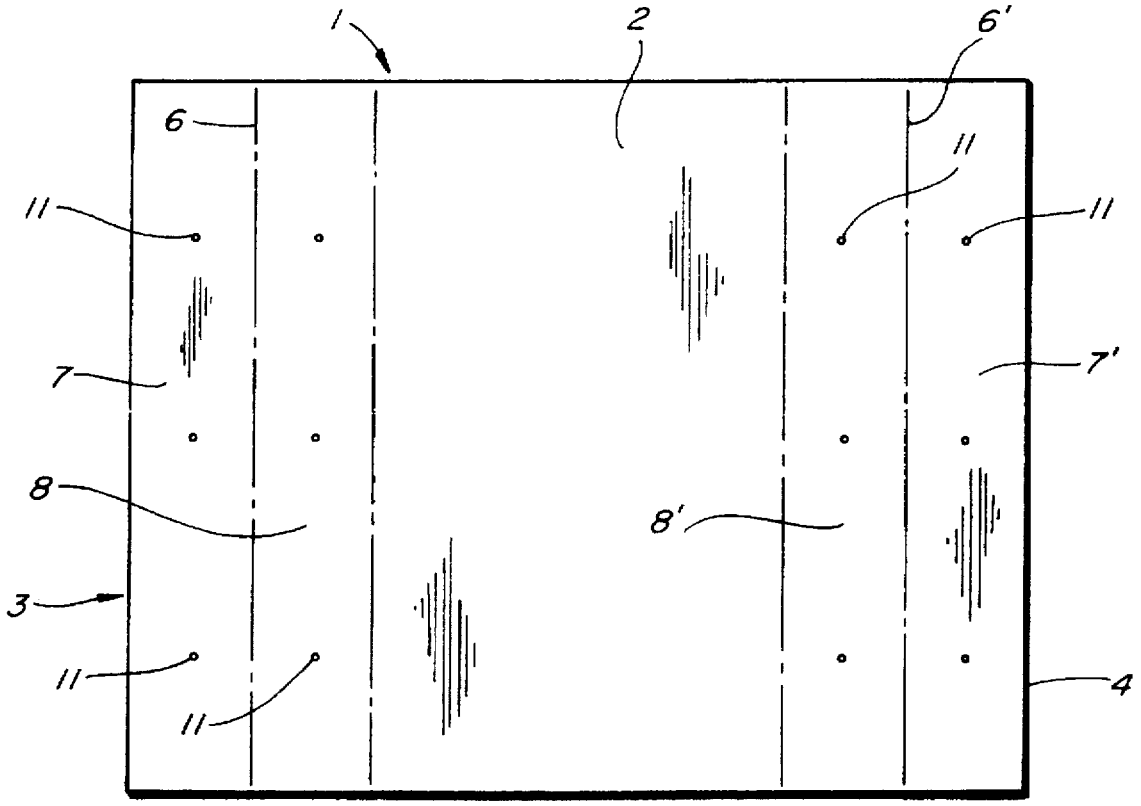
FIG. 1 is a plane view of the invalid bed guard sheet.
Figure 2:
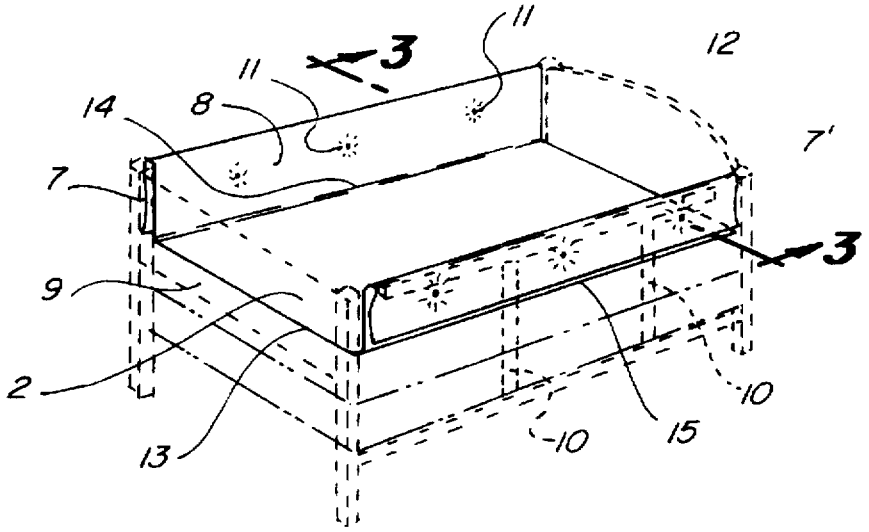
FIG. 2 is a perspective view of the invalid bed guard sheet shown attached to the invalid bed. The invalid bed is shown in dotted lines on FIG. 2.

An invalid bed guard sheet 1 is presented which is universally adaptable to all types of invalid type beds utilizing raisable guardrails. The invalid bed guard sheet 1 comprises essentially a central portion 2 which is laid horizontally across the upper surface of the bed mattress 8, as best shown in FIGS. 1 and 2. This guard sheet has left 3 and right 4 guard pad sections which fit around the left and right raised guardrails.

The left and right guard pad sections are divided into left 7 and right 7' outside pads and left 8 and right 8' inside pads. These inside pads 8 and 8' may be made of a cushioned material such as sheepskin padding. Alternatively, both the inside and outside pad sections may be made of sheepskin or other cushioned padding to protect both the patient in the bed and anyone coming into contact with the bedrail from a direction outside the bed.

The normal invalid bed comprises a mattress 9, and adjustable bedrails 10. The mattress 9 has a head 12, a foot 13, and left 14 and right 15 edges. The bedrails generally have vertical posts attached to a horizontal bar. It is these vertical posts and horizontal bar that may be raised to keep the patient in the invalid bed. The horizontal bedrail bar 5 (FIG. 3) forms the apex of the security system for the invalid bed. The left 3 and right 4 cushioned guard pads are designed to fit around the left and right railing system as described below.

Figure 3:
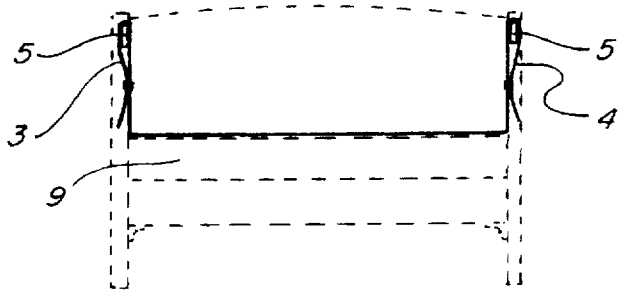
FIG. 3 is a cutaway view of FIG. 2 taken along lines 3—3 of FIG. 2.
Figure 4:
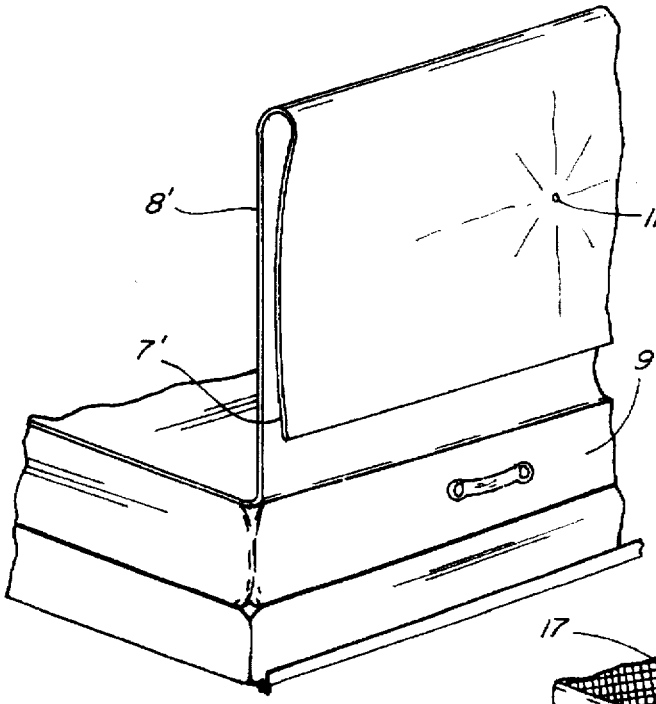
FIG. 4 is an expanded perspective view of the bottom right corner of the right guard pad.

With the left and right metal guardrails raised, as shown in FIGS. 2 and 3, the guard sheet may be installed. The central portion 2 of the sheet is laid horizontally across and on top of the mattress 9. The left guardrail pad 3 is then raised such that the inside left guardrail pad 8 is located on the inside of the guardrail as shown in FIGS. 2 and 3 while the outside guardrail pad 7 is located on the outside of the guardrail. The top edge 6 and 6' of the pad rests on the top horizontal bar 5. The guardrail pad is then secured to the guardrail by means of button fasteners 11. Each button fastener would have a female button on the outside pad and a male stud on the inside pad. The right pad is then secured to the right raised metal rail in a similar fashion and fastened securely.

The invalid bed guard sheet is now installed and eliminates the gap which is normally found between the mattress 9 and bedrails 10. The installation of this device adds to patient comfort while still allowing for the raising or lowering of the metal guardrails as desired. Removal of the left and right guard pads 3 and 4 is simply accomplished by unsnapping the fasteners and allowing the left and right guard pads to fall below the mattress level. The guard pads 3 and 4 may be placed vertically downward between the mattress and the floor, along the same lines as the lowered guardrail.

Figure 5:
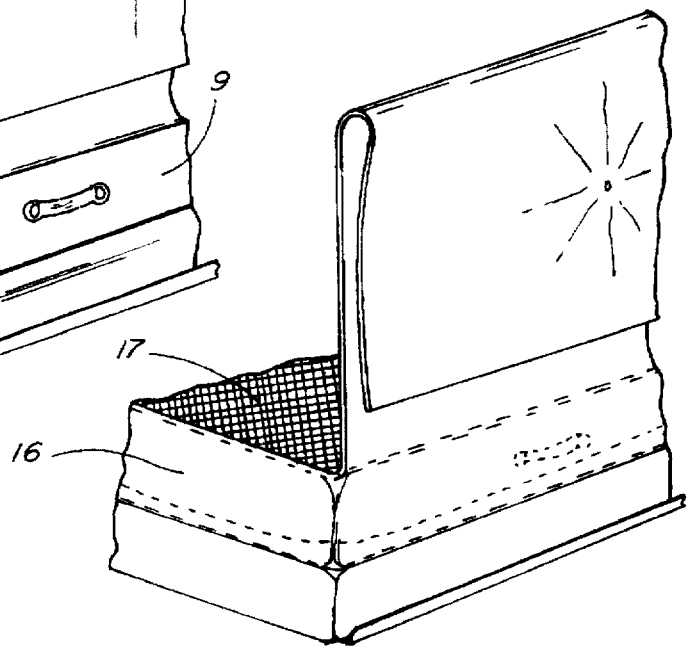
FIG. 5 is an alternative partial perspective view of the invalid bed guard sheet showing the lower fitted sheet 16 and thin cloth netting 17.

Several variations of this particular invention could be made, while still keeping within the spirit and disclosure of the instant device. The central sheet 2 could be made of standard cotton fabric or it could be made of a lightweight thin cloth netting fabric 17 as shown in FIG. 5. For example, the central portion 2 of the guard sheet could have sewn to it beneath its horizontal surface a pre-fitted lower sheet such that the invalid bed guard sheet could be form fitted to a conventional mattress. The left 3 and right 4 guard pad sections would still be attached to the central portion 2 of the guard sheet as shown in FIGS. 1 and 2. The device would function identically to the device shown in FIG. 1. However, this particular invalid bed sheet would also be form fitted to the mattress.

Obviously, this particular device could be made in sizes compatible with the mattresses found on various patient beds. Furthermore, the length of the inside and outside cushioned pads could be made to accommodate different heights of metal guardrails. Additionally, the means of attaching the guard pads to the raised metal rails could vary. For example, the button fasteners could be changed for hook and loop fasteners, hole and button fasteners or any type of fastener deemed convenient. Furthermore, the left and right guard pads could be sewn along their ends such that only the bottom edge of the guard pads was open. The bottom edge of the guard pads could then be fitted over the metal guardrails to establish the essentially U-shaped invalid bed guard sheet shown in FIGS. 1 through 4.

All of the above variations of this device are within the spirit and disclosure of this invention.

Having fully disclosed my device, I claim:

1. A sheet for an invalid bed, said bed having an upper mattress with a head, foot and left and right edges, and left and right raisable metal guard rails, comprising:

(a) a continuous bed sheet having a central section that covers the entire upper surface of said mattress and left and right attachable guardrail pad sections;

(b) wherein each guardrail pad section is integral with and attached along the full length of said left and right mattress edges, respectively and wherein each pad section has an inner and outer portion such that each pad section may be placed over and fastened to a raised metal guardrail by fastening said inner and outer portions together with fastening means, providing padding for the inside and outside of said metal rail.

2. A sheet, for an invalid bed, as in claim 1, wherein said fastening means may be snaps, buttons or hook and loop fasteners.

3. A sheet, for an invalid bed as in claim 1, wherein the central section of said sheet may be form-fitted for ready attachment to a mattress.

4. A sheet, for an invalid bed as in claim 1, wherein each guardrail section is cushioned.

5. A sheet, for an invalid bed as in claim 1, wherein said central portion may be made of thin cloth netting.

* * * * *